US006655025B2

(12) United States Patent
Kashiyama et al.

(10) Patent No.: US 6,655,025 B2
(45) Date of Patent: Dec. 2, 2003

(54) CONNECTOR AND LOCKING FIXTURE THEREOF

(75) Inventors: Motohisa Kashiyama, Shizuoka-ken (JP); Junichi Hamamoto, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/152,567

(22) Filed: May 23, 2002

(65) Prior Publication Data

US 2002/0137402 A1 Sep. 26, 2002

Related U.S. Application Data

(62) Division of application No. 09/866,750, filed on May 30, 2001.

(30) Foreign Application Priority Data

May 31, 2000 (JP) ..... P2000-162787

(51) Int. Cl.[7] ..... H01R 43/20

(52) U.S. Cl. ..... 29/876; 29/753; 29/863; 29/874

(58) Field of Search ..... 29/874, 876, 863, 29/753, 884

(56) References Cited

U.S. PATENT DOCUMENTS 3,537,167 A * 11/1970 Lawson
4,272,879 A * 6/1981 Wigby et al.
4,335,497 A * 6/1982 Casey
4,557,048 A * 12/1985 Cordeiro
5,083,370 A * 1/1992 Koch et al.
6,276,052 B1 * 8/2001 Avenoso et al.

FOREIGN PATENT DOCUMENTS

EP 0733463 A2 9/1996
JP 07-161405 6/1995

* cited by examiner

*Primary Examiner*—Carl J. Arbes
(74) *Attorney, Agent, or Firm*—Finnegan, Henderson, Farabow, Garrett, & Dunner, L.L.P.

(57) ABSTRACT

The connector includes a first housing with a first engagement part. A holder is configured to be mounted to the first housing. The holder has a first mating part corresponding to the first engagement part. The holder has a second engagement part for engagement of the first engagement part and the first mating part.

18 Claims, 5 Drawing Sheets

CONNECTOR AND LOCKING FIXTURE THEREOF

This is a division of application Ser. No. 09/866,750, filed May 30, 2001 which is incorporated herein by reference.

BACKGROUND OF THE INVENTION

The present invention relates to a connector with a housing and a rear holder and a locking fixture thereof.

A connector has been known, which has a connector housing formed integrally with a rear holder through flexible belt-configured hinges (refer to Japanese Patent Application Laid-Open Publication No. 7-161405).

The housing has two rear holders formed onto respective upper and lower face respectively, using hinges of flexible belt. The housing has guide and lock protrusions provided on both sides thereof. The respective guide and lock protrusions lock the rear holders at both a provisional and a regular position.

When the hinges are flexed, the rear holders are pushed and fitted in from above and below, and thus fixed in a provisional lock position.

The provisional locking fixture has a fixture housing, a conveyor belt for conveying the connector housing, and a pusher. The pusher is slid into an angled guide hole defined by the fixture housing. The front surface of pusher is a plane.

SUMMARY OF THE INVENTION

The conventional provisional locking fixture allows the rear holder to stop at a specified position to be pushed by the pusher, without positioning function to the pusher. Thus, unless the rear holder is positioned accurately in correspondence with the pusher, the rear holder will not be provisionally locked into the connector housing.

However, to stop the connector housing at an accurate position, using intermittent conveyance, requires a complicated mechanism with high accuracy, thus causing high production costs.

The pusher and the angled guide hole need a space to allow clearance between them, and the complete prevention of looseness is difficult, which can result in deviation between the pusher and rear holder. Thus, the conventional rear holder and connector housing engagement often has lock mistake.

An object of the invention is to provide a connector that has a rear holder with a positioning function relative to a pusher to ensure accurate lock of a connector housing and a locking fixture thereof.

A first aspect of the invention is provided with the following connector. The connector includes a first housing with a first engagement part. A holder is configured to be mounted to the first housing. The holder has a first mating part corresponding to the first engagement part. The holder has a second engagement part for engagement of the first engagement part and the first mating part.

Preferably, the first housing has a third engagement part to be engaged with the first mating part.

Preferably, the first engagement part has a first protrusion. The first mating part has a first recessed part for the first protrusion to be inserted in.

Preferably, the second engagement part has a second recessed part.

Preferably, the first mating part has a first recessed part. The third engagement part has a second protrusion to be inserted in the first recessed part.

A second aspect of the invention is provided with the following locking fixture for a connector according to the first aspect of invention. The fixture includes: a second housing configured to house the first housing and the holder. A pusher is inserted in the second housing for slide. The pusher is configured to be engaged with the second engagement part.

Preferably, the second engagement part has a second recessed part. The pusher has a projection configured to be fitted in the second recessed part.

Preferably, the pusher is configured to form the first housing and the holder. The projection is configured to form the second engagement part of the holder.

A third aspect invention is provided with the following assembly method for a connector. A first housing and a holder of a connector are housed in a second housing of a fixture. A pusher is fitted in a recessed part of a holder. A pusher is pushed to be slid in a second housing for a first engagement part of a first housing and a first mating part of a holder to be engaged with each other.

Preferably, the assembly further includes the step of: sliding the first engagement part and the first mating part for the first mating part and a third engagement part of the first housing to be engaged with each other.

During the locking operation, even if slight deviation of the holder occurs, the engagement of the second engagement part corrects the position of the holder, thereby achieving a reliable provisional lock. Lightning of the holder causes difficult occurrence of warp thereof, and provisional lock impossibility due to deformation of the holder is prevented.

The projection of the pusher and the recessed part of the holder to be fitted with each other correct the position of the holder, and the holder is accurately positioned to ensure a reliable provisional lock.

After molding the housing and holder, the identical mold constitutes the provisional locking fixture or the pusher. According to the fixture, with the pusher and second engagement part being engaged with each other for forming, pressure of the pusher against the holder positions the holder accurately, achieving a reliable provisional lock.

BRIEF DESCRIPTION OF THE ACCOMPANYING DRAWINGS

DETAILED DESCRIPTION OF THE PREFERRED EMBODIMENTS

Embodiments of the present invention will hereby be explained with reference to the drawings.

Figure 1:
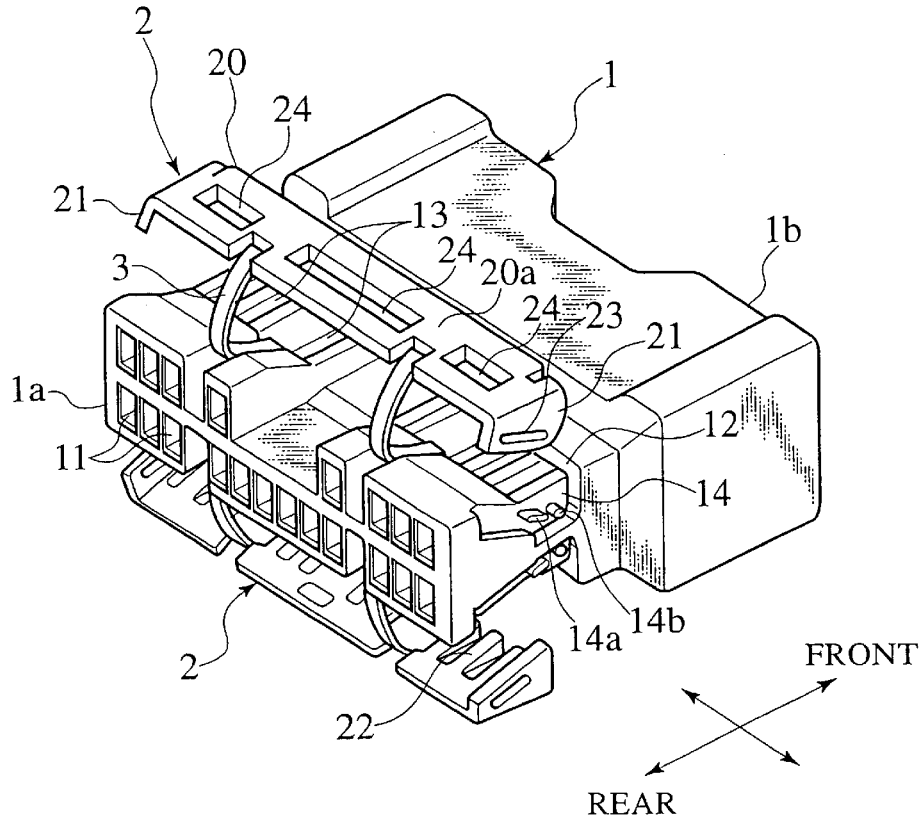
FIG. 1 is a perspective view of a connector with a rear holder in accordance with the embodiment of the invention.

As shown on FIG. 1, a substantially rectangular parallelepiped connector housing 1, integrally molded of a resin, has a pair of rear holders 2 attached to its upper and lower faces respectively via hinges 3, made of flexible belt. Housing 1 has tubular terminal housing chambers 11 separated in honeycomb at the rear end surface 1*a* thereof. When male terminal fixtures 101 of wire terminals are inserted in the terminal housing chambers 11 (as shown on FIG. 3.), the fixtures 101 are engaged with lances inside housing chambers 11 (not shown in Figs.) to ensure regular lock. The ends of inserted terminal fixtures face to the front end surface 1*b* of housing 1, which is connected with female terminal fixtures housed in a mating female connector housing.

The housing 1 has upper and lower side faces that define mating recesses 12 to be fitted to rear holders 2. The recesses 12 have rear-holder insertion openings 13 in slit configuration along a longitudinal or front to rear direction, in both the top and bottom faces of housing chambers 11. Housing 1 has mounting recesses 14 on its both side faces in correspondence to recesses 12. Recesses 14 have guide protrusions 14*a*, or first engagement parts, provided to the central portion thereof, the protrusions being inclined in a longitudinal direction. At an extension line of the protrusions 14*a*, lock protrusions 14*b*, or third engagement parts, is provided. The protrusions 14*a* and 14*b* are to ensure that rear holders 2 lock at respective provisional and regular engagement positions.

The rear holders 2 are formed in a gate configuration as shown on FIG. 1, with lock pieces 21 in a sleeve configuration on both sides of rear holder bodies 20, or covers, thereof. The rear holders are integrally formed with and supported by the ends of flexible-belt hinges 3 that are fixed to housing 1 on both the left and right of respective upper and bottom surfaces. Rear holder bodies 20 each contain three recesses 24 as second engagement parts in a longitudinal direction. Recesses 24 each may have a bottom, are formed through a rear holder body 20 or be of an arbitrary number thereof.

Figure 2:
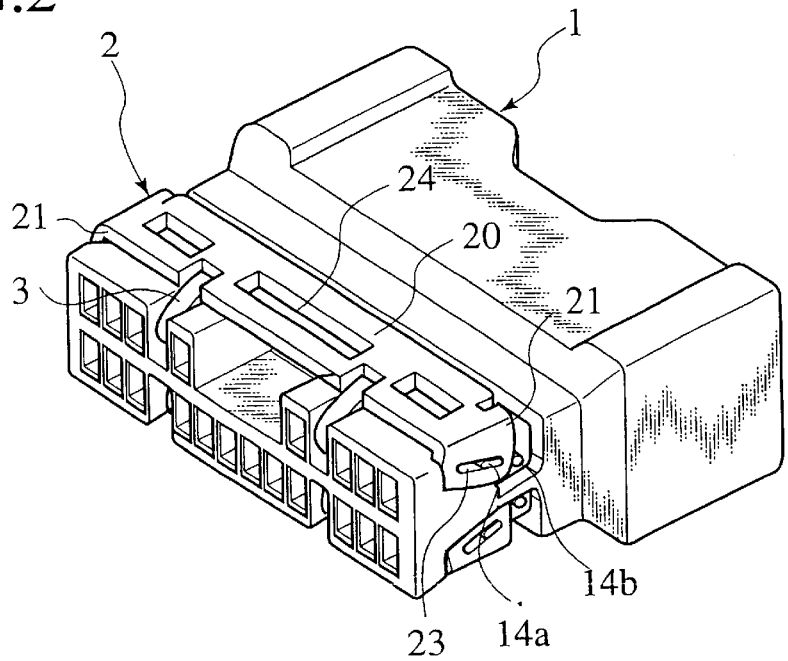
FIG. 2 is a perspective view of a rear holder in provisional lock.
Figure 3:
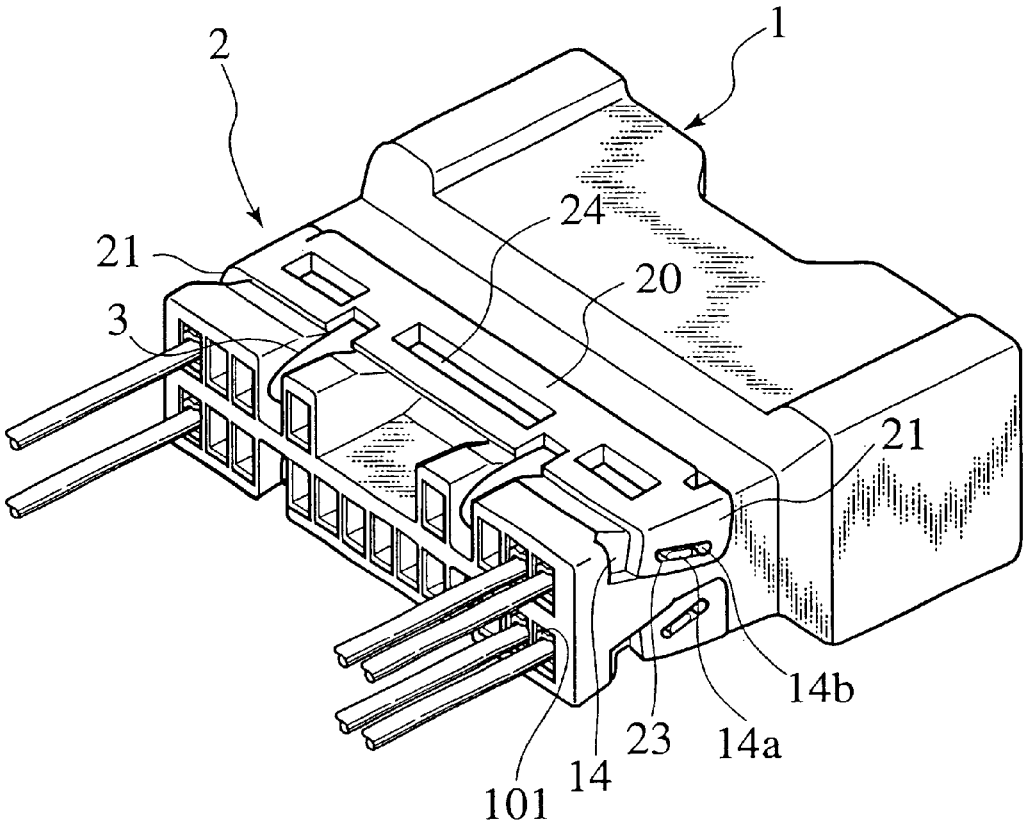
FIG. 3 is a perspective view of a rear holder in a regular lock.

The rear holder bodies 20 have lock pieces 22 on their inner sides which correspond to insertion openings 13 and project toward the front portion of the connector in a triangular configuration (refer to FIG. 1). Engagement pieces 21 define elongated guide holes 23 as slots or first mating parts that are to be fitted to guide and lock protrusions 14*a* and 14*b* to ensure mounting operation of rear holder 2 to housing 1. The mounting operation allows mounting at both the provisional and regular lock positions as shown in FIGS. 2 and 3. Movements to both the positions are performed by slide of rear holders 2 along the longitudinal direction.

Upon insertion of the terminal fixtures 101 as shown on FIG. 3, outer surfaces 20*a* of rear holder bodies 20 are pushed forward from the provisional lock position, so that engagement pieces 21 flex outward to over the lock protrusions 14*b*. Lock protrusions 14*b* are fitted into the slots 23 and thereby held in the regular lock position. According to the operation, the lock pieces 22 of rear holder bodies 20 enter the chambers 11 to be engaged with the side portions of housed terminal fixtures 101 for secondary lock. Specifically, the following is preformed.

Before insertion of terminal fixtures 101 in housing chambers 11, first, push of both rear holders 2 into recesses 12 from above and below, with hinges 3 being flexed, causes their fitting, thus achieving their fixing at the provisional lock position as shown in FIG. 2. Specifically, engagement pieces 21 are fitted into only guide protrusions 14*a* to locate at the rear of recesses 14 without fitting with lock protrusion 14*b*, being pushed into recesses 14 in a substantially normal direction relative to the top and bottom surfaces of housing 1. This operation causes engagement pieces 21 to be resiliently deformed and to come over guide protrusions 14*a*, and guide protrusions 14*a* to be fitted into slots 23, rendering belt-configured hinges 3 to be flattened into housing 1 as in FIG. 2. The connector in the provisional lock state is conveyed to a terminal insertion step, without hinges 3 being caught, bending or tearing during conveyance.

After the insertion of all terminal fixtures 101 is completed, if the holder bodies 20 are moved obliquely forward along guide protrusions 14*a*, the engagement pieces 2 come over lock protrusions 14*b*, causing lock protrusions 14*b* to be fitted into slots 23 in addition to guide protrusions 14*a*. Thus, rear holders 2 are fixed at the regular lock position by both protrusions 14*a* and 14*b* that are fitted in slots 23.

Figure 4:
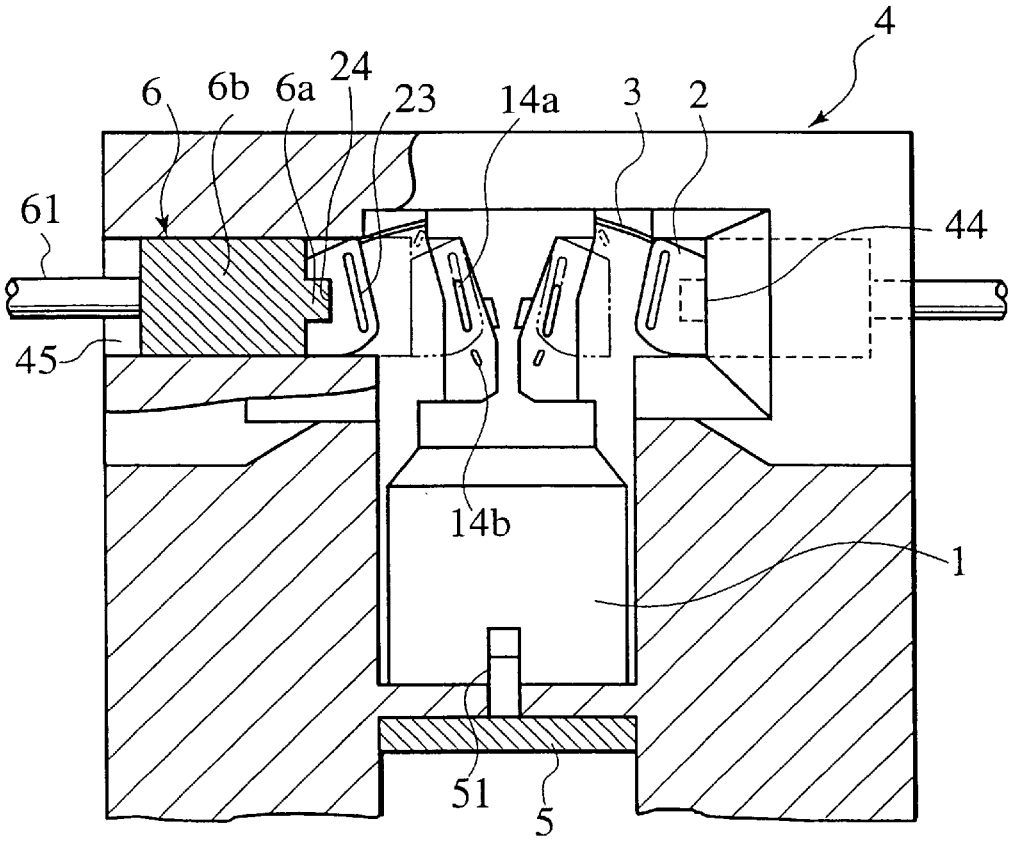
FIG. 4 is a sectional view of a connector and a mold in provisional lock by means of a provisional locking fixture.

FIG. 4 shows a provisional locking fixture for the provisional lock of rear holder 2 to housing 1.

The provisional locking fixture includes a housing 4 in tube serving as a guide means, a conveyor belt 5 as a conveyor means for conveying connector housing 1, and a pusher 6. Conveyor belt 5 is driven intermittently with repetition of movement and stopping in cooperation with the motion of pusher 6. A conveyor pawl 51 projecting above conveyor belt 5 locks housing 1 for conveyance. Rear holder 2 to be moved is guided by a rear holder guide groove 44.

The embodiment has the pusher to be slid into housing 4. The pusher has a projection 6*a* at its end, and a pusher body 6*b* in housing 1 and rear holder 2 that are set into housing 4 for provisional lock, the pusher body to push rear holder 2 to be provisionally locked to housing 1.

The housing 4 has an angulated guide hole 45 normal to a rear holder guide groove 44. The guide hole 45 contains the pusher 6 to be moved forward and backward therein. Pusher 6 is a plane on its front face with a projection 6*a* in its center in order to fit into the recess 24.

The housing 1, conveyed by pawl 51 of belt 5, is transferred in the guide groove 44 thus to be located substantially at the provisional lock position, that is, the movement of it to the forward position of pusher 6 causes the stopping of belt 5. Pusher 6, driven by a push rod 61, pushes rear holder 2 toward recess 12. At this time, the fitting of projection 6*a* into the recess 24 of rear holder 2 corrects the position of rear holder 2, even if the position had slightly deviated, ensuring accuracy.

Thus, as is shown by the imaginary line in FIG. 4, the engagement pieces 21 fit over the guide protrusions 14*a* and into the slots 23. The rear holders 2 are pushed in a transverse direction normal to the outside of the rear portions of recesses 14, thus being mounted in the provisional lock position.

The connector housing 1 in the provisional lock is conveyed to a terminal insertion process. In the process, terminal fixtures 101, crimped with wire terminal ends, are inserted for a first lock state.

Next, the manual oblique forward movement of rear holder 2 along guide protrusions 14*a* fits lock protrusions 14*b* into slots 23, which in turn fixes rear holder 2 in the regular lock position.

As described above, the connector with rear holder of the embodiment has the recesses 24 provided to the exterior of rear holders 2, a recess for projection 6*a* to be fitted into, projection 6*a* being provided at the end of pusher 6 to ensure provisional lock, the pusher for rear holder 2 to be pushed into housing 1 for provisional lock. In operation with pusher 6 for provisional lock, any slight deviation of the position of rear holder 2 would be corrected by the fitting of projections 6*a* into recesses 24, which achieves accurate positioning for reliable provisional lock.

Figure 5:
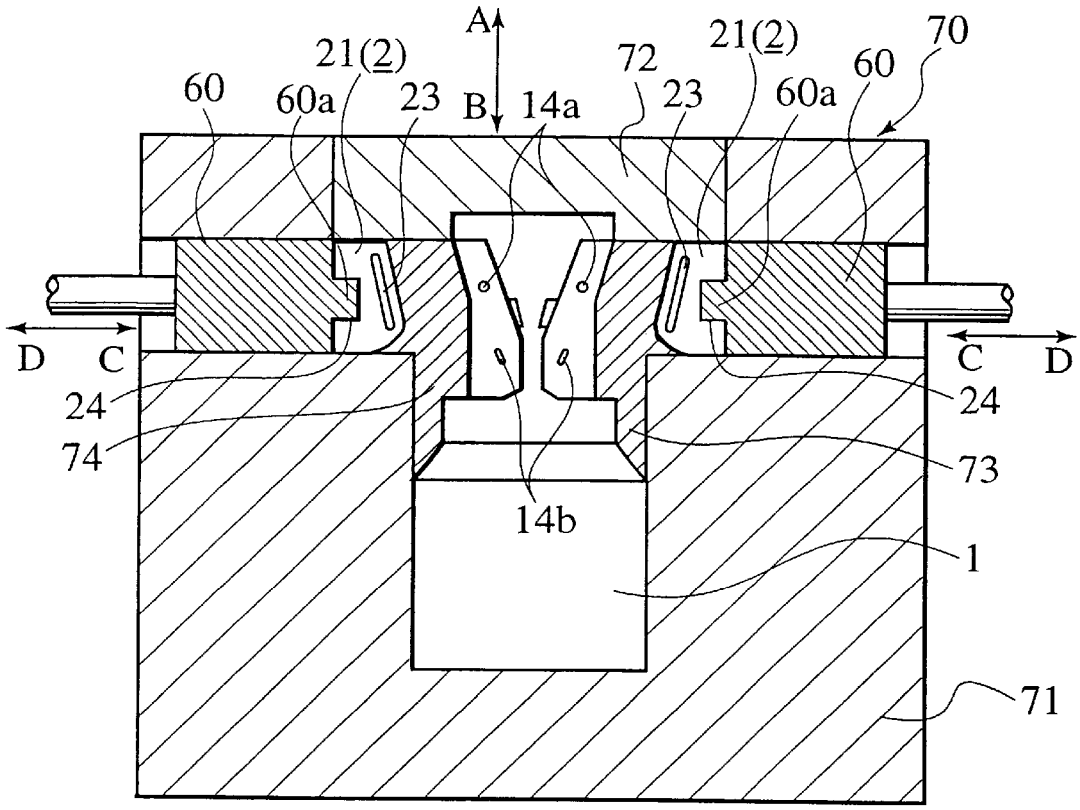
FIG. 5 is a sectional view of a connector with a rear holder that serves as a mold.

FIG. 5 shows another embodiment of a provisional locking fixture. The provisional locking fixture employs a mold 70.

In the embodiment, a pusher in correspondence with provisional lock pusher 6 of the aforementioned embodiment includes a connector housing 1, and slide molds 60 as mold 70 for rear holders 2. A projection in correspondence with the projection 6*a* of the aforementioned embodiment includes a mold projection 60*a* to form recesses 24 of rear holders 2, and projecting from the wall face of slide mold 60.

The mold 70 includes a lower mold 71; an upper mold 72 to be moved vertically as shown by arrows A and B; a slide mold 60 to be moved horizontally as shown by arrows C and D or parallel with the paper; and a slide mold 73 to be moved horizontally or normally to the paper. The cooperation of molds 71, 72 and 73 allows housing 1 and rear holders 2 to be formed simultaneously. The mold 70, without forming the aforementioned belt-configured hinge 3, separately and independently forms housing 1 and rear holder 2.

When mold 70 functions as a provisional locking fixture for the mounting of rear holder 2 to housing 1, lower mold 71 works as a guide for a base and slide mold 60, slide mold 60 works as a pusher to push and move rear holder 2, and the upper mold 72 works as a holder for housing 1. Next, the operation of embodiment is explained.

First, when housing 1 and rear holder 2 are formed, each of molds 71, 72, 73 and 60, as shown on FIG. 5, is arranged, and a resin is filled through a filling hole, to form housing 1 and rear holder 2. After molding, slide mold 73 is pulled back in a normal direction to the paper. Slide mold 60 is moved in a direction of C to bias rear holder 2 toward housing 1. At this time, rear holder 2, with projection 60*a* being fitted in recess 24 and held on the wall face of slide mold 60, is moved toward housing 1.

Continuing each movement of slide molds 60 in a direction of C, the engagement pieces 21, being resiliently deformed, fit over the guide protrusions 14*a* and into slots 23, to achieve the provisional lock of rear holder 2 relative to housing 1.

In the embodiment, with the projections 60*a* being fitted into recesses 24 after molding, slide molds 60 press against rear holders 2, positioning accurately to ensure provisional lock.

The embodiment employs mold 70 for the molding of housing 1 and rear holder 2, and, following molding, the provisional lock operation of rear holder 2 is performed with mold 70, which reduces the number of operation steps considerably.

The entire content of Japanese Patent Applications P2000-162787(filed on May 31, 2000) is incorporated herein by reference.

Figure 6:
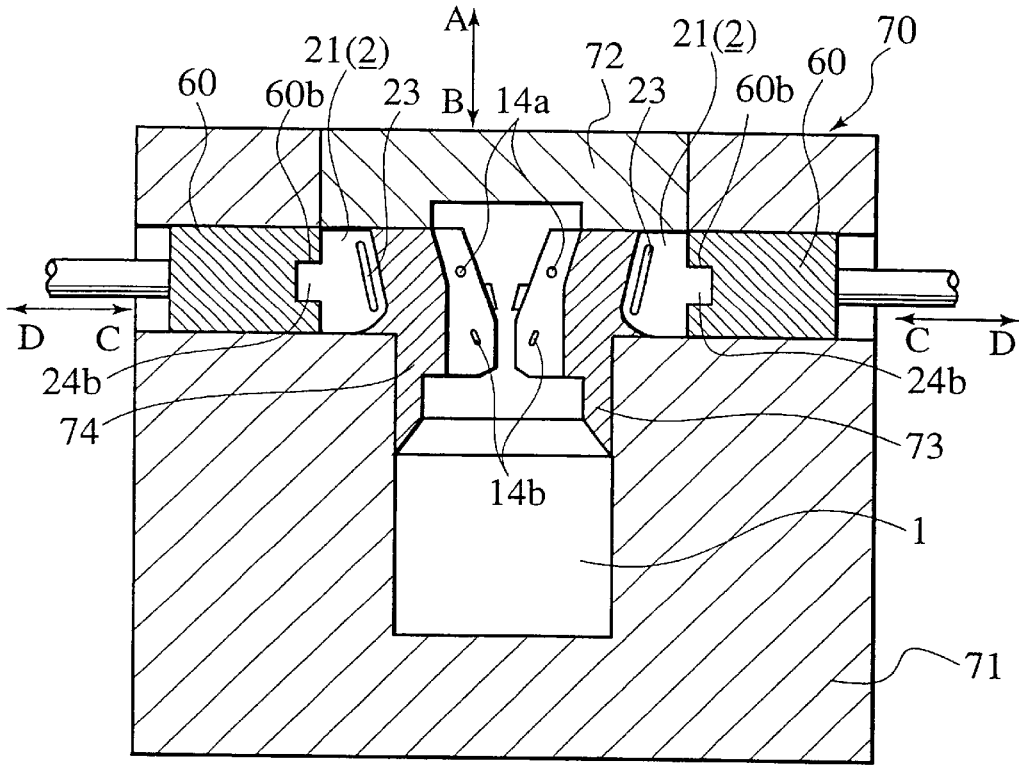
FIG. 6 is sectional view of a connector with a rear holder that serves as a mold, according to another embodiment.

Although the invention has been described above by reference to certain embodiments of the invention, the invention is not limited to the embodiments described above. Modifications and variations of the embodiments described above will occur to those skilled in the art, in light of the above teachings. For example, as shown on FIG. 6, the molds 60 may have recess 60*b* and the rear holders 2 may have projections 24*b* to be fitted into the recesses 60*b*. The scope of the invention is defined with reference to the following claims.

What is claimed is:

1. An assembly method for a connector, comprising the steps of:

housing a first housing and a holder of a connector in a second housing of a fixture;

fitting a pusher in a recessed part of the holder;

pushing the pusher to be slid in the second housing so that a first engagement part of the first housing and a first mating part of the holder engage with each other.

2. An assembly method according to claim 1, further comprising:

sliding the first engagement part and the first mating part so that the first mating part and a third engagement part of the first housing engage with each other.

3. An assembly method according to claim 1, wherein the pusher includes a projection extending from a face that protrudes into the recessed part of the holder.

4. An assembly method according to claim 1, wherein the step of fitting a pusher in a recessed part of the holder includes fitting a projection extending from the pusher into the recessed part of the holder.

5. An assembly method according to claim 1, including correcting the position of the holder with the pusher.

6. An assembly method according to claim 1, including:

inserting terminal fixtures into the first housing; and sliding the first mating part so that the first mating part and a third engagement part of the first housing engage with each other.

7. An assembly method for a connector, comprising the steps of:

housing a first housing and a holder of a connector in a second housing of a fixture, the first housing being adapted to receive wire terminals;

fitting a pusher in a recessed part of the holder;

pushing the pusher to be slid in the second housing so that a first engagement part of the first housing and a first mating part of the holder join each other in a provisional locking position.

8. An assembly method according to claim 7, further comprising:

sliding the first engagement part and the first mating part so that the first mating part and a third engagement part of the first housing join each other in a regular locking position.

9. An assembly method according to claim 7, wherein the pusher includes a projection extending from a face that protrudes into the recessed part of the holder.

10. An assembly method according to claim 7, wherein the step of fitting a pusher in a recessed part of the holder includes fitting a projection extending from the pusher into the recessed part of the holder.

11. An assembly method according to claim 7, including correcting the position of the holder with the pusher.

12. An assembly method according to claim 7, including:

inserting terminal fixtures into the first housing; and sliding the first mating part so that the first mating part and a third engagement part of the first housing join each other in a regular locking position.

13. An assembly method for a connector, comprising the steps of:

housing a connector housing and a connector holder in a fixture housing;

fitting a pusher in a recessed part of the connector holder;

pushing the pusher in the fixture housing so that a first engagement part of the connector housing and a first mating part of the connector holder join each other in a provisional locking position.

14. An assembly method according to claim 13, further comprising:

sliding the first mating part so that the first mating part and a third engagement part of the connector housing join each other in a regular locking position.

15. An assembly method according to claim 13, wherein the pusher includes a projection extending from a face that protrudes into the recessed part of the connector holder.

16. An assembly method according to claim 13, wherein the step of fitting a pusher in a recessed part of the connector holder includes fitting a projection extending from the pusher into the recessed part of the connector holder.

17. An assembly method according to claim 13, including correcting the position of the connector holder with the pusher.

18. An assembly method according to claim 13, including:

inserting terminal fixtures into the connector housing; and sliding the first mating part so that the first mating part and a third engagement part of the connector housing join each other in a regular locking position.

* * * * *